United States Patent [19]

Conkey

[11] 4,268,997

[45] May 26, 1981

[54] COMPARTMENT DOOR HOLDER FOR RECREATIONAL VEHICLES

[76] Inventor: Walter J. Conkey, 3821 Ferntower, West Covina, Calif. 91792

[21] Appl. No.: 49,424

[22] Filed: Jun. 18, 1979

[51] Int. Cl.[3] ..... E06B 7/16

[52] U.S. Cl. ..... 49/383; 16/137

[58] Field of Search ..... 292/288; 49/397, 383; 16/137, 191, 138

[56] References Cited

U.S. PATENT DOCUMENTS

| | | | |
|---|---|---|---|
| 83,967 | 11/1868 | Howell . | |
| 2,746,537 | 5/1956 | Joslin | 49/397 X |
| 3,135,012 | 6/1964 | Wessel | 16/137 |
| 3,174,179 | 3/1965 | Benson | 16/137 |
| 3,325,854 | 6/1967 | Steigerwald | 16/137 |

FOREIGN PATENT DOCUMENTS

| | | | |
|---|---|---|---|
| 307609 | 3/1929 | United Kingdom | 292/288 |

*Primary Examiner*—Kenneth Downey

*Attorney, Agent, or Firm*—Gausewitz, Carr, Rothenberg & Edwards

[57] ABSTRACT

A device for holding a recreational vehicle compartment access door in an open position includes a bracket plate having a pair or oppositely extending arms which are interconnected and offset by an intermediate bracket portion to which is attached a laterally projecting pin. The device is attached to a pinless hinge connecting the access door to its frame by opening the door and inserting the pin axially into an end of the hinge so that the arms contact radially opposed surfaces on the door and frame and hold the door open. The pin is adjustable along the intermediate bracket portion toward or away from the arm that contacts the frame, making the device readily adaptable to a wide variety of hinge and frame configurations.

13 Claims, 7 Drawing Figures

FIG. 1.
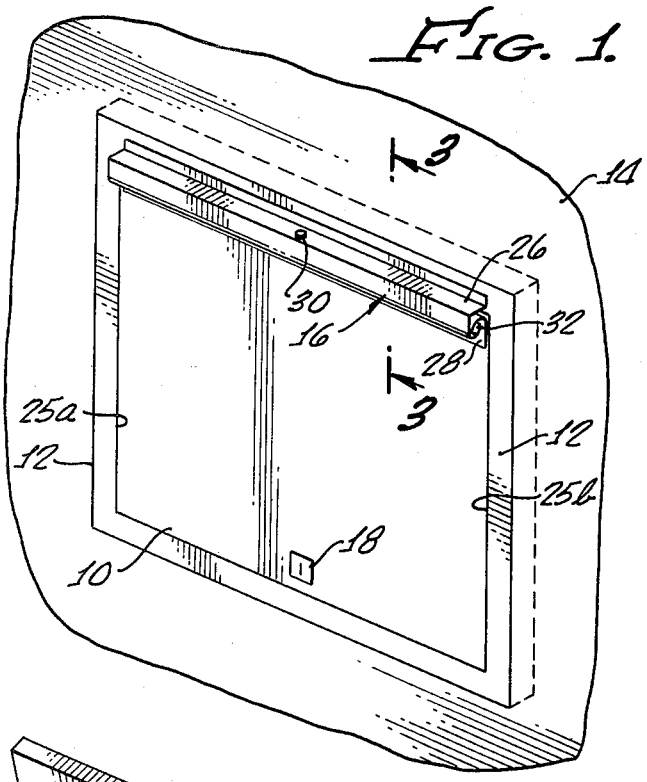
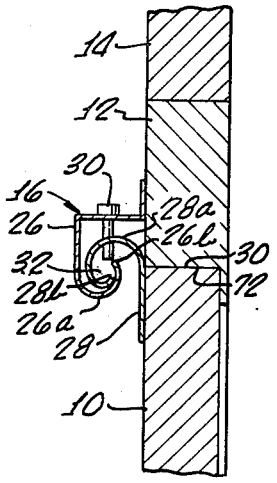
FIG. 3.
FIG. 2.
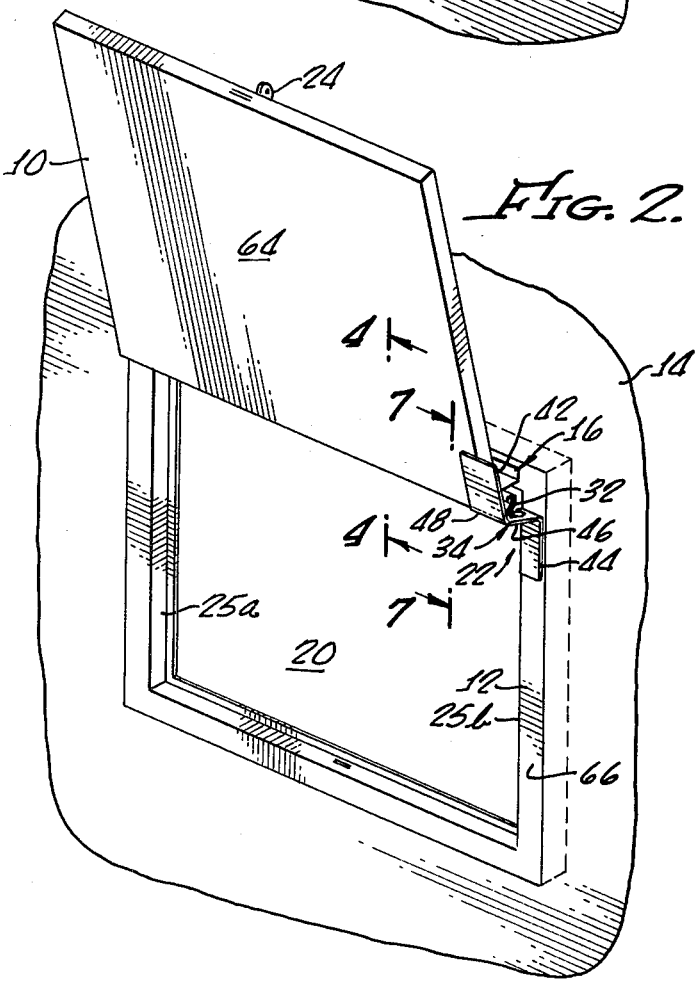
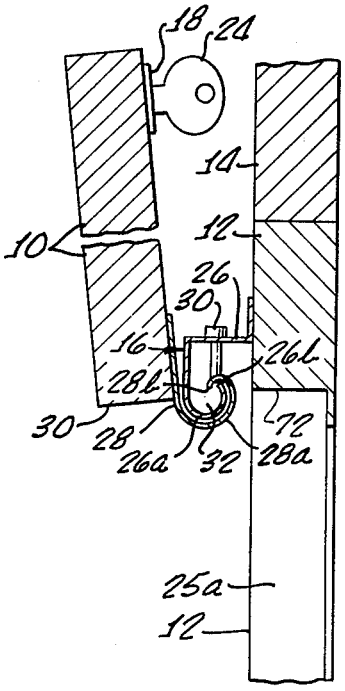
FIG. 4.

FIG. 5.
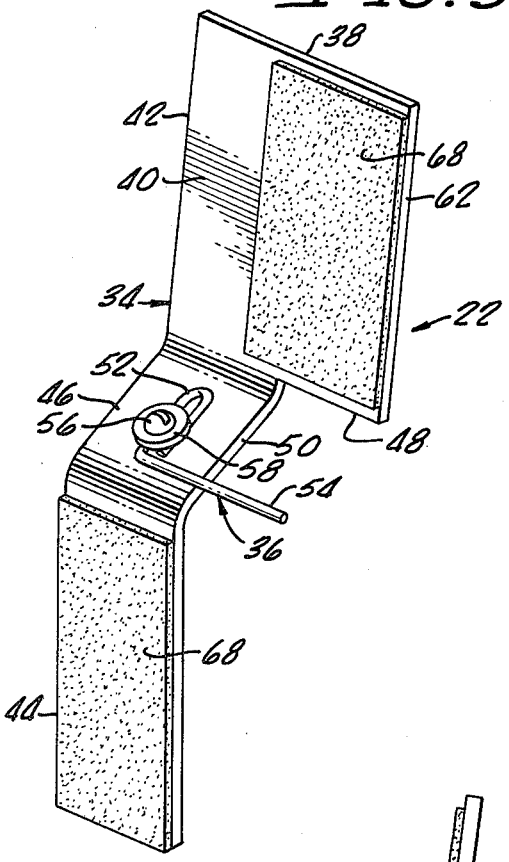
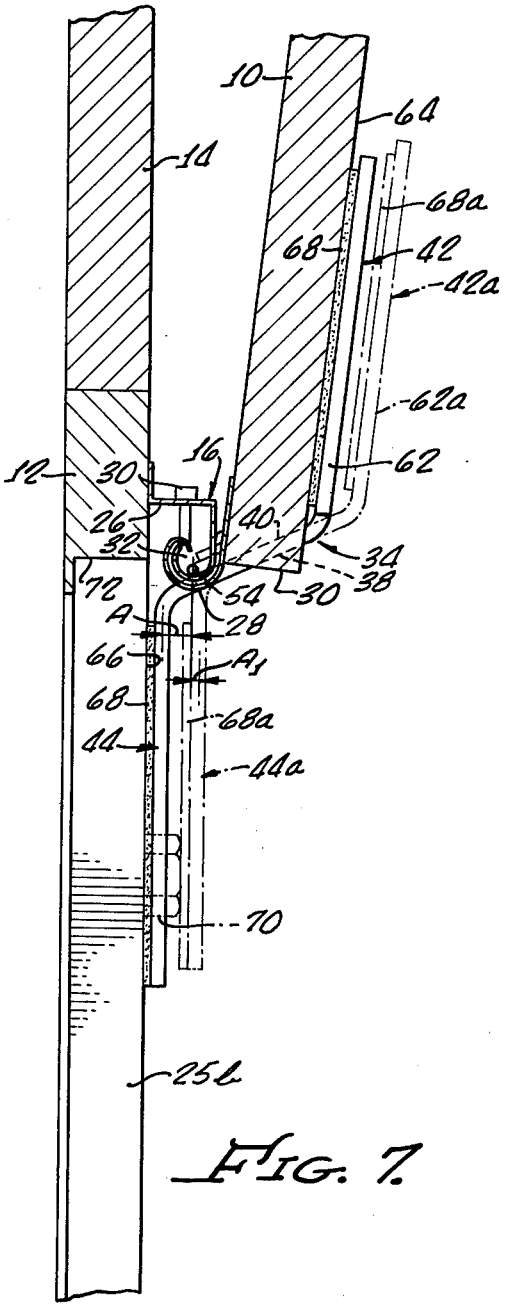
FIG. 7.
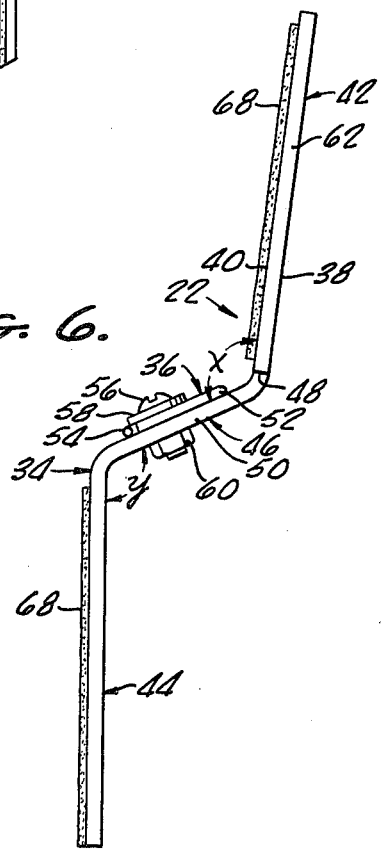
FIG. 6.

COMPARTMENT DOOR HOLDER FOR RECREATIONAL VEHICLES

BACKGROUND OF THE INVENTION

This invention relates to door holders, and more particularly to door holders adapted to hold an exterior compartment door on a recreational vehicle or the like in an open position.

Most of the millions of recreational vehicles now in use (such as motor homes, travel trailers and the like) have a number of compartments accessible from the exterior of the vehicle which function as storage spaces or which house various operating components of the vehicle such as generators, auxiliary motors, fuel and water systems, etc. Access to each of these compartments is obtained through a door mounted on a frame attached to the exterior panels of the vehicle.

Typically, each of the access doors is hinged to the top horizontal element of its frame by a pinless, hollow hinge and opens upwardly (although some access doors are hinged on the side with the same type of hinge). Normally, each door is provided with a keyed lock.

An annoying and frequently occurring problem associated with such access doors is that of trying to hold one of them in an open position while loading, unloading, or attempting to work on equipment in its compartment—tasks which often cannot be accomplished with one hand while the other hand holds the door up. (Darkness often adds a third element to be managed with two hands—a flashlight).

A makeshift method commonly employed to solve the problem is to prop the access door open with a wooden or metal rod extending between the undersurface of the opened door and either the ground or the bottom of the door frame. This method, though universally practiced by recreational vehicle owners, is far less than satisfactory for a variety of reasons. First, the various access doors on the typical recreational vehicle are mounted at varying heights and are of various sizes, thus requiring, in many cases, a different length prop for each door. Also, it is difficult (if not impossible) to prop up one of the access doors in its fully opened position (i.e., with the door swung upwardly against the exterior of the vehicle) so that the door itself does not hinder access to its compartment. Further, such props are frequently and very easily dislodged by their user, allowing the access door to fall shut and strike the user or impede his work. Finally, the horizontally projecting access door and its prop (especially at night) can represent safety hazards to a person walking by the opened door.

For the determined recreational vehicle owner, several rather expensive alternate solutions to the door holding problem are currently available. Each of these alternate solutions, however, entails the permanent installation of a device on the access door, its adjacent vehicle panel, or both, at each compartment. Such devices include a magnet attached to each door and its adjacent panel, spring-urged clips fixed to and above each door, and straps attached to each door and its adjacent panel. Each of these devices, however, typically entails a relatively high cost for each access door at which they are permanently installed, in addition to the time and effort for installation. Additionally, installation of each of these devices requires the use of fasteners which puncture the vehicle's panels, leaving unsightly holes in the panels if it is later decided to remove the devices.

In summary, none of the prior devices provides a solution to the access door holding problem which is convenient, inexpensive and reliable. Accordingly, it is an object of this invention to provide a door holding device that eliminates or minimizes above-mentioned problems and disadvantages.

SUMMARY OF THE INVENTION

In carrying out principles of the present invention, in accordance with a preferred embodiment, a device for removable attachment to a pinless hinge on a recreational vehicle compartment access door to hold the door in an open position includes door holding means for contacting radially opposed surfaces on the door and its frame and holding the door open when the device is attached to the hinge with the door in an open position. An attachment member is carried by the door holding means and has a rigid end portion projecting laterally beyond an edge thereof. The device is attached by inserting the projecting portion of the attachment member axially into an end opening in the hinge.

According to a feature of the invention, adjusting means are provided so that the attachment member may be adjusted relative to the door holding means to selectively vary the distance between the attachment member end portion and the surface of the door holding means that contacts the frame when the device is attached, making the device readily adaptable to a wide variety of hinge and frame configurations.

BRIEF DESCRIPTION OF THE DRAWINGS

FIG. 1 is a perspective view of a portion of a recreational vehicle exterior panel containing a typical compartment access foor attached to a frame by a pinless hinge;

FIG. 2 is a perspective view similar to that in FIG. 1 but with a door holder of the present invention attached to the hinge and holding the access door in an open position;

FIG. 3 is an enlarged cross-sectional view taken along line 3—3 of FIG. 1;

FIG. 4 is an enlarged cross-sectional view taken along line 4—4 of FIG. 2;

FIG. 5 is a perspective view of a door holder embodying principles of the present invention;

FIG. 6 is a right side elevational view of the door holder illustrated in FIG. 5; and FIG. 7 is a greatly enlarged cross-sectional view taken along line 7—7 of FIG. 2.

DETAILED DESCRIPTION

FIG. 1 illustrates a typical recreational vehicle compartment access door 10 (in a closed position) which an embodiment of the present invention is designed to conveniently hold in an open position. The access door 10 is carried in a frame 12 mounted in an exterior panel 14 (only a portion of which is shown) of the recreational vehicle and is pivotally secured to the frame 12 by a pinless hinge 16 extending horizontally across an upper portion of the frame. A keyed lock 18 is provided in the access door 10 adjacent its lower edge. Behind the access door 10 is a compartment 20 (FIG. 2) in which is housed miscellaneous vehicle operating equipment such as an auxiliary motor, generator, fuel and water system components, etc., or which serves simply as a storage space.

FIG. 2 illustrates the access door 10 swung upwardly and held in an open position by a door holder 22 of the present invention which has been removably attached to the hinge 16 as will be described below. It should be noted that a key 24 has been left in the lock 18—a convenient feature of the present invention also described below.

The pinless hinge 16 is conventional and exemplary of a type of hinge which is used on recreational vehicle access doors, extending continuously along the entire width of the door 10 and having its opposite ends adjacent inner frame edges 25*a* and 25*b* as indicated in FIG. 1. The hinge has a first hinge section 26 (FIGS. 3 and 4) fixedly attached to and extending along the upper portion of the frame 12 and a second hinge section 28 fixedly attached to and extending along an upper edge 30 of the access door 10. The hinge sections 26, 28 have curved end portions 26*a* and 28*a* having similar curvatures along the lengths of the hinge sections 26 and 28. With the door 10 in the open position illustrated in FIG. 4, the curved portion 28*a* is adjacent and curved outwardly of the curved portion 26*a*, with a curved end 28*b* of the hinge section 28 overlapping an end 26*b* of the hinge section 26. When the door 10 is in a closed position as illustrated in FIG. 3, the hinge section 28 is positioned inwardly of the hinge section 26. A screw 30 extends downwardly through the hinge section 26, substantially at the center of the length of the hinge (FIG. 1), and is received in a slot (not shown) which extends around the hinge section 28 transversely to its longitudinal extent. The screw 30 and the slot in the hinge section 28 preclude relative longitudinal movement between the two hinge sections but allow the door 10 to pivot between its open and closed positions. The hinge 16 has an opening 32 extending axially through it and allows the door 10 to be pivoted upwardly until it abuts (or nearly abuts) the outer surface of the panel 14.

Referring now to FIGS. 5 and 6, the door holder 22 includes door holding means in the form of a longitudinally offset bracket plate 34 which carries an elongated attachment member or pin member 36. The bracket plate 34 is preferably formed from a single piece of metal such as aluminum and has opposite outer and inner surfaces 38 and 40, and door and frame contacting arms 42, 44 which form elongated end portions of the bracket. The contacting arms 42, 44 are interconnected by and extend longitudinally in generally opposite directions from opposite ends of an intermediate bracket portion 46.

Each of the offset contacting arms lies substantially in a plane nearly parallel to and offset from the plane of the other and forms an obtuse angle (x for arm 42 and y for arm 44) with the intermediate bracket portion 46. Angle x is preferably slightly larger than angle y, angle x being approximately 110 degrees and angle y being approximately 102 degrees in the embodiment of the door holder illustrated in FIGS. 5 and 6.

The door contacting arm 42 is wider than the frame contacting arm 44 and the intermediate bracket portion 46, and has a door contacting portion 48 that projects laterally beyond an edge 50 of the intermediate bracket portion 46.

The pin member 36 has an adjusting means formed as a U-shaped end portion 52 that extends perpendicularly to a straight, rigid end portion 54 and is releasably secured to the inner surface of the intermediate bracket portion 46 by a suitable releasable fastener such as, for example, a bolt 56, a washer 58 and a nut 60 as indicated.

The straight end portion 54 extends generally transversely of the bracket plate 34 and has an outer portion which projects laterally beyond the edge 50 of the intermediate bracket portion 46, terminating approximately in line with an edge 62 of the door contacting portion 48 of the door contacting arm 42. By loosening and retightening the bolt 56, the position of the pin member 36 along the length of the intermediate bracket portion 46 may be adjusted to selectively vary the distance between the straight end portion 54 of the pin member 36 and the plane of the frame contacting arm 44 for purposes described below. Other means for adjustably securing the pin member 36 to the intermediate bracket portion will be evident to those skilled in the art.

To hold the access door 10 in an open position, the laterally projecting portion of the end 54 of the pin member 36 is inserted axially into an end of the hinge opening 32 (with the door 10 in an open position) with the inner surfaces of the door contacting portion 48 of the door contacting arm 42 and the frame contacting arm 44 contacting, respectively, radially opposed surfaces 64 and 66 on the door 10 and the frame 12 (FIGS. 2 and 7).

With the bracket plate 34 thus removably attached to the hinge 16, the end portion 54 of the pin member 36 contacts the inner surface of the hinge section 26 as illustrated in FIG. 7. A clockwise rotation of the bracket plate 34 about the pin member end portion 54 (caused by the downward force of the door 10 acting against the door contacting arm 42) is precluded by the frame contacting arm 44 which is forced against the frame surface 66.

To preclude damage to the door and frame surfaces 64, 66 by the contacting arms 42, 44, surface protecting means in the form of strips 68 (FIG. 5) of a resilient material are secured to the inner surfaces of the door contacting portion 48 of the door contacting arm 42 and the frame contacting arm 44, the outer surfaces of the strips 68 thus constituting the door and frame contacting surfaces of the bracket plate 34.

As previously mentioned, the pin member 36 is adjustable so that the distance between its end portion 54 and the plane of the frame contacting arm 44 may be varied. The desirability of this feature can be seen in FIG. 7. When the bracket plate 34 is attached to the hinge 16 so that the frame contacting arm 44 contacts the surface 66 of the frame 12, the distance between the pin member end portion 54 and the plane of the frame contacting arm 44 is, for instance, A. However, if there is a protruberance on the frame surface 66, such as a bolt head 70, the frame contacting arm contacts the protruberance, and not the surface 66, and the bracket plate 34 (and thus the pin member end portion 54) is shifted slightly outwardly with respect to the hinge 16. The shifted position of the bracket plate 34 is indicated by dashed lines in FIG. 7, the contacting arms 42, 44 and the protective strips 68 being given the subscript "a" in their adjusted positions.

It can be seen that the presence of the bolt head 70 or a similar protruberance on the frame (or a differently shaped hinge) causes the distance A to be reduced $A_1$ and requires that the pin member end portion 54 be repositioned toward the plane of the frame contacting arm 44 to accommodate the altered configuration. Similarly, by adjusting the pin member end portion 54, a wide variety of different hinge configurations may be compensated for, making the door holder easily adaptable for use on access doors on different recreational vehicles.

Since the required adjustment is toward or away from the plane of the frame contacting arm 44, it can be seen that the intermediate bracket portion 46 could be perpendicular thereto. However, it can also be seen that (for a given bracket plate and door contacting arm length) a material cost savings is accomplished by forming the intermediate bracket portion at an obtuse angle to the frame contacting arm as previously described.

Referring now to FIG. 2, another desirable feature of the door holder 22 may be seen. With the bracket plate 34 attached to the hinge 16, only the door contacting portion 48 projects inwardly of the inner edge **25*b* of the frame 12. This provides unobstructed access to the compartment 20** (unlike the commonly used prop) thus precluding unintentional dislodgment of the door holder causing the access door to unexpectedly fall shut.

Additionally, since the pinless hinge extends continuously and completely across the frame opening with its end adjacent the inner frame edges **25*a*, 25*b*, the door holder is designed to engage the hinge from outside the frame opening. It is this design which allows the bracket arms 42, 44 to be elongated to contact the surfaces 64, 66 along contact lengths limited only by the width and length of the surfaces 64 and 66 respectively. This in turn allows the resisting force of the bracket arms on surfaces 64, 66** to be spread over an extended area, thus effectively eliminating potential marring of those surfaces by the bracket arms.

Another convenient feature of the door holder illustrated and described herein may also be seen in FIGS. 2 and 4. Typically, the pinless hinge 16 on the access door 10 allows the door to be swung upwardly until it contacts (or at least nearly contacts) the adjacent panel 14. However, because angle x is slightly greater than angle y (FIG. 6) the door contacting arm 42 is inclined slightly outwardly from the panel 14 when the bracket plate 34 is attached to the hinge (FIGS. 4 and 7). This arrangement causes the door 10 to incline slightly outwardly of the panel 14 so that the key 24 may be left in its lock 18 (when the door 10 is held open by the door holder) without being forced against and marring the surface of the panel 14.

While the foregoing description has been directed to access doors which open upwardly (as is most common on recreational vehicles), the door holder described and illustrated is also readily usable with access doors which open to the side. This may clearly be seen by rotating FIG. 2 to a position in which the access door 10 appears to open to the left. In such a side-opening door, having an open-ended vertically extending hinge, the holder pin would be inserted into the upper end of the hinge.

The door holder described and illustrated herein has many advantages over prior art door holding devices. It is quickly and removably attachable and, because of its adjustability, fits almost any recreational vehicle compartment access door (regardless of size) having a pinless hinge, leaving both hands completely free to work in, load or unload the compartment when the door holder is attached. Thus, only one door holder is needed to hold open any of the access doors on the typical recreational vehicle. No costly permanent installation is required, and unlike prior art devices, no damage to the vehicle surfaces is necessary in order to use the door holder. It is compact, portable and easily stored. Finally, the door holder described is very durable (having no moving parts once adjusted) and very economical—both to manufacture and use.

The foregoing detailed description is to be clearly understood as given by way of illustration and example only, the spirit and scope of this invention being limited solely by the appended claims.

What is claimed is:

1. A door holder adapted to be removably attached to a pinless door hinge to hold a door in an open position, said hinge pivotally securing said door to a frame and having an axially extending end opening, said door holder comprising:

(a) door holding means for contacting radially opposed surfaces on said door and frame and holding said door in said open position when said door holder is attached to said hinge with said door in said open position, and (b) an attachment member carried by said door holding means, said attachment member having a rigid end portion projecting outwardly of said door holding means and having a cross-section and length of sufficiently small size for removable insertion into said hinge opening.

2. A door holder as recited in claim 1 wherein said door holding means further include a door contacting surface extending laterally outwardly relative to said frame contacting surface.

3. A door holder for use on a recreational vehicle compartment door or the like, said door being secured to a frame by a pinless hinge extending continuously across the frame opening and having an axially extending opening at at least one end thereof, said door holder comprising:

(a) an elongated bracket plate having opposite outer and inner surfaces, an intermediate longitudinal portion and a pair of elongated, longitudinally offset end portions interconnected by and extending longitudinally in generally opposite directions from opposite ends of said intermediate portion, said intermediate portion forming an angle with each of said end portions, said end portions defining frame and door contacting arms respectively adapted to contact radially opposed frame and door surfaces, along inner surfaces of said arms, when said door holder is attached to said hinge with said door in an open position, to thereby hold said door in said open position, said door contacting arm being offset outwardly of said frame contacting arm by said intermediate portion of said bracket plate, and (b) a pin member secured to said intermediate portion of said bracket plate, said pin member having an end portion projecting laterally beyond an edge of said intermediate portion and adapted for removable axial insertion into said hinge opening to attach said door holder to said hinge.

4. A door holder as recited in claim 3 wherein said pin member is releasably secured to said intermediate portion of said bracket plate, and wherein said door holder further comprises adjusting means for adjusting the position of said pin member relative to said intermediate portion of said bracket plate to selectively vary the distance between said pin member and said frame contacting arm of said bracket plate.

5. A door holder as recited in claim 3 wherein said intermediate portion of said bracket plate forms a first obtuse angle with said frame contacting arm and a second obtuse angle with said door contacting arm, said second obtuse angle being at least slightly greater than said first obtuse angle.

6. A door holder as recited in claim 3 wherein said door contacting arm has a door contacting portion thereon projecting laterally beyond said intermediate portion of said bracket plate and said frame contacting arm and adapted to contact said door surface when said door holder is attached to said hinge with said door in said open position, said frame contacting arm and intermediate bracket portion both extending outwardly from and being clear of an inner edge of said frame.

7. A door holder comprising (a) a frame contacting arm extending in a first direction, (b) a door contacting arm spaced from and extending from said frame contacting arm in a direction opposite said first direction, said door contacting arm having a section laterally offset relative to said frame contacting arm, (c) an intermediate door holder portion fixedly connected to and extending transversely between said arms, and (d) a door holder mounting pin fixed to said intermediate portion and projecting laterally from and beyond said intermediate portion.

8. The door holder of claim 7 wherein said frame contacting arm extends at a first angle relative to said intermediate portion, and wherein said door contacting arm extends at a second angle relative to said intermediate portion, said second angle being greater than said first angle.

9. In a system for providing access to the space within a recreational vehicle compartment or the like, the combination of:

(a) a structural panel forming a part of said recreational vehicle, (b) a door frame in said structural panel having an opening therein communicating with said space within said compartment and adapted to receive a compartment access door, (c) a compartment access door pivotally attached to said door frame by a pinless hinge having an axially extending opening at an end thereof, and (d) a door holder as recited in claim 1 or 4 attached to said hinge and holding said compartment access door in said open position, said end portion of said attachment member or pin member extending into said hinge opening and portions of said door holder contacting radially opposed surfaces on said door and said frame.

10. For use with a recreational vehicle access door pivotally connected in a door frame opening by an open-ended pinless hinge, a method of holding said door in an open position without disassembly of said hinge or attaching additional equipment to said door and frame, said method comprising the steps of:

(a) forming a bracket having mutually offset oppositely extending arms interconnected by an intermediate bracket portion, (b) attaching to said intermediate bracket portion a door holder mounting pin and positioning the pin to project transversely of said bracket and outwardly of said intermediate portion thereof, (c) opening said door, (d) inserting said pin into an end of said hinge, and engaging said arms with said frame and said door respectively.

11. The method of claim 10 wherein said bracket forming step (a) includes causing said arms to extend in opposite but mutually inclined directions.

12. The method of claim 10 wherein said last mentioned step comprises respectively engaging said arms with an inner surface of said door and an outer surface of said frame laterally offset from the frame opening.

13. A door holder adapted to be removably attached to a pinless door hinge to hold a door in an open position, said hinge pivotally securing said door to a frame and having an axially extending end opening, said door holder comprising:

(a) door holding means for contacting radially opposed surfaces on said door and frame and holding said door in said open position, said means including a frame contacting surface thereon adapted to contact said frame when said door holder is attached to said hinge with said door in said open position, (b) an attachment member carried by said door holding means, said attachment member having a rigid end portion projecting outwardly of said door holding means and adapted for removable insertion into said hinge opening, and (c) adjusting means for adjusting the position of said attachment member relative to said door holding means to selectively vary the distance between said attachment member end portion and said frame contacting surface of said door holding means.

* * * * *